United States Patent [19]

Buzzell

[11] 4,277,034

[45] Jul. 7, 1981

[54] PAPER ROLL HOLDER WITH DANCER BAR FOR USE WITH PRINTERS AND THE LIKE

[75] Inventor: James M. Buzzell, Deerfield, N.H.

[73] Assignee: Centronics Data Computer Corp., Hudson, N.H.

[21] Appl. No.: 40,897

[22] Filed: May 21, 1979

[51] Int. Cl.[3] ..... B65H 17/02

[52] U.S. Cl. ..... 242/67.3 R; 242/68.4

[58] Field of Search ..... 242/55, 67.2, 67.3 R, 242/68.4, 68, 67.1 R, 75.2

[56] References Cited

U.S. PATENT DOCUMENTS

| | | | |
|---|---|---|---|
| 1,515,382 | 11/1924 | Cheesman | 242/68.4 |
| 2,872,188 | 2/1959 | Harkins | 242/55 |
| 3,411,686 | 11/1968 | Bender | 242/55 X |
| 3,770,549 | 10/1971 | Carbone | 242/68.4 |
| 3,966,135 | 6/1976 | Baker | 242/67.3 R |

*Primary Examiner*—Edward J. McCarthy
*Attorney, Agent, or Firm*—Weinstein & Sutton

[57] ABSTRACT

A paper supply roll holder having an axle insertable through the core of a paper supply roll for rotatably supporting the paper supply roll upon a supporting bracket. The rearward portion of the supporting bracket rests upon a suitable support surface while the forward ends of a pair of resilient arms are inserted into openings upon a printer housing for releasable locking therebetween and to positively locate the paper supply holder relative to the printer. The paper extends from the supply roll over a resiliently-mounted dancer bar and into the printer where it is guided therethrough by web feeding means of the incremental-feed type. The spring elements resiliently supporting the dancer bar are adapted to yield upon incremental advancement of the web feeding means, to thereafter rotate the supply roll through a small angle as the web feeding means pauses during the printing of a line to assure that the web is fed in an orderly fashion.

The paper roll supporting axle is provided with slideable caps for positively locating the paper roll and being adjustable to accommodate paper rolls of varying lengths.

12 Claims, 14 Drawing Figures

PAPER ROLL HOLDER WITH DANCER BAR FOR USE WITH PRINTERS AND THE LIKE

BACKGROUND OF THE INVENTION

The present invention relates to paper supply means and more particularly to a novel paper supply holder for use with a printer and having a dancer bar for assuring orderly feeding of the web from the supply reel, and which is especially advantageous for use with web feeding means of the incremental-feed type.

Printers of the high-speed type have a capability of printing under control of a computer or communications link receiver in which sheets of paper would have to be changed rather rapidly due to the printing speed capability of such printers. In order to limit the number of paper feed operations required to be performed per unit time, it is typical to adapt the printer to receive and feed paper from a continuous elongated web of indeterminate length. A web of this nature is typically provided in a large supply roll. The web is arranged to rotate upon a supporting shaft or pin to enable feeding of the paper web from the supply reel. The support for the supply roll is preferably of the free-wheeling type to enable the paper to be fed rapidly without being torn. However, a free-wheeling support of this type also carries with it the disadvantage of allowing the supply reel to continue rotation due to the large inertia of the supply reel and due to the force imparted to the supply reel through the pulling force exerted on the outermost layer of the paper web, thereby enabling the paper web to begin to unravel and feed more paper than is necessary during a paper feed operation. This is particularly disadvantageous when utilizing large paper web supply reels with printers of the incremental paper-feed type, which impart an abrupt pulling force upon the paper web.

BRIEF DESCRIPTION OF THE INVENTION

The present invention is characterized by providing a highly-simplified and yet unique paper roll holder which is adapted to allow the paper web to be substantially freely unraveled and which is provided with dancer bar means adapted to yield its quiescent position to provide for the orderly feeding of the web by allowing an increment of linear length of the web already unwound from the supply roll but not yet fed into the printer to be rapidly fed into the printer while causing the paper supply roll to unwind slowly as the incremental paper feed mechanism pauses after a line feed and during the subsequent printing of each line. In addition, the dancer bar imparts sufficient drag to the paper web to prevent more than the desired amount of paper web to be fed from the supply reel, thus maintaining the web on the supply reel substantially fully and tautly wound and preventing the supply reel from unraveling to feed more paper from the supply reel than is required due to the performance of a web of an incremental paper feed operation.

OBJECTS OF THE INVENTION AND BRIEF DESCRIPTION OF THE FIGURES

It is therefore one object of the present invention to provide a paper supply roll holder for use with a printer paper feed device and which is adapted to rotatably support a supply roll and feed the paper web from the supply roll in a neat and orderly manner.

Another object of the present invention is to provide a paper supply roll holder of the character described hereinabove and which utilizes a dancer bar assembly resiliently supporting an unwound portion of the web for preventing the paper supply roll from unraveling more paper than is required.

Still another object of the present invention is to provide a paper supply roll of the character described hereinabove and in which the dancer roll assembly utilizes spring means for buffering the impact of an abrupt line feed operation to prevent the abrupt movement of the paper web from reaching the supply roll.

Still another object of the present invention is to provide a novel paper supply roll holder for use with a printer and having resilient locking arms for releasably engaging cooperating mounting openings provided on said printer, so as to positively locate the paper supply roll holder and hence the paper supply roll relative to said printer.

Still another object of the present invention is to provide a novel paper supply roll holder having an axle with slideably-mounted end cap members for adjustably positioning a paper supply roll upon said axle and further for accommodating paper supply rolls of different axial lengths.

The above, as well as other objects of the present invention, will become apparent when reading the accompanying description and drawings in which:

FIG. 1*a* shows a side elevational view of a paper supply roll holder designed in accordance with the principles of the present invention and showing a portion of the elements of a printer associated therewith.

FIG. 1*b* shows a partial top plan view of the assembly of FIG. 1*a*.

FIG. 2*a* shows a detailed side elevational view of the holder of FIG. 1*a* with the paper supply roll removed.

FIG. 2*b* shows a front elevational view of the paper supply roll holder of FIG. 2*a*.

FIG. 3*a* shows a top plan view of a portion of the holder of FIG. 2*a*.

FIG. 3*b* shows a front elevational view of a support portion of the paper supply roll holder of FIG. 2*a*.

FIG. 4*a* is a top plan view of one spring and a portion of the dancer bar of FIGS. 1*a* and 2*a* and the manner in which said spring supports one end of the dancer bar.

FIG. 4*b* shows a side view of the spring of FIG. 4*a*.

FIG. 5*a* shows a top plan view of the paper supply roll axle of FIGS. 1*a* and 2*a*.

FIG. 5*b* shows a right-hand end view of the axle of FIG. 5*a*.

FIG. 5*c* shows a left-hand end view of the axle of FIG. 5*a*.

FIG. 5*d* shows a sectional view of the axle of FIG. 5*a* looking in the direction of arrows 5*d*–5*d*.

FIG. 5*e* shows a side view of one of the adjustable end caps of FIG. 2*b*.

FIG. 5*f* shows an end view of one of the end caps of FIG. 2*b*.

DETAILED DESCRIPTION OF THE INVENTION

Figure 1A:
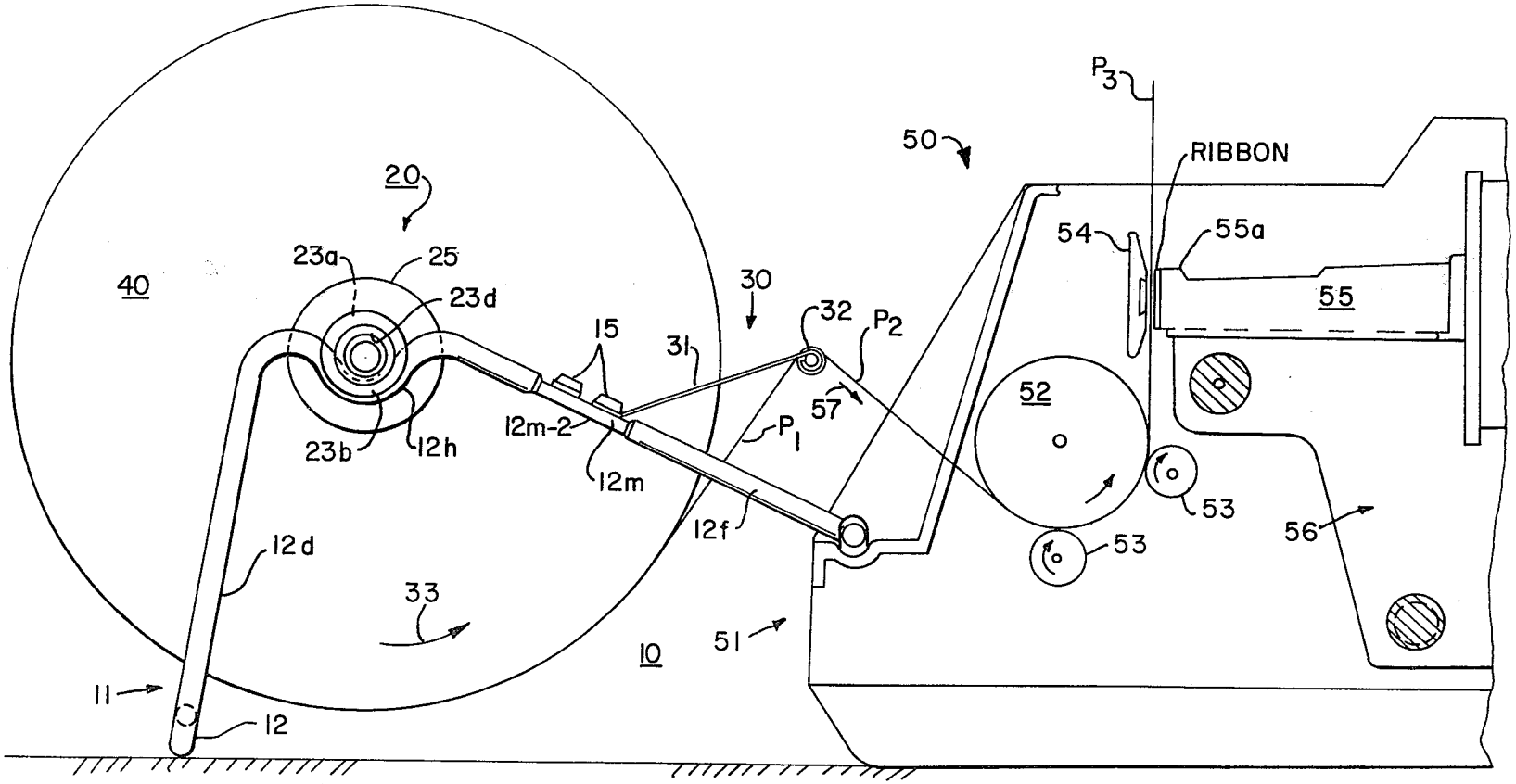

FIG. 1*a* shows a paper supply roll holder 10 designed in accordance with the principles of the present invention and is comprised of a support assembly 11, an axle assembly 20, and a dancer bar assembly 30. The paper supply reel 40 is comprised of a large roll of a paper web of indeterminate length, which is rotatably positioned upon axle assembly 20. The free end of the paper web extends from the underside of the supply reel, as shown best in FIG. 1*a*, and upwardly and over the top of dancer bar assembly 30 and thereafter downwardly and into the printer 50 comprised of a printer housing 51 supporting a rotatable paper feed roller assembly 52, rotatable pinch rollers 53, and a stationary paper supporting platen 54. The paper web moves upwardly through the gap provided between the printing surface of platen 54 and a slideably-mounted print head 55 mounted along a print head carriage supporting means 56.

The printer housing is provided with a shelf 57 facing the supply roll holder assembly 10 and having a pair of semicircular-shaped grooves 57*a* and 57*b* (see FIG. 1*b*), which are arranged immediately adjacent to substantially circular-shaped openings 57*e* and 57*f*, respectively provided in upright sidewalls 57*c* and 57*d*, which upright sidewalls are provided on opposite sides of shelf 57.

The paper supply roll holder assembly 11 can best be seen in detail in FIGS. 2*a*, 2*b*, 3*a*, and 3*b*, said holder support being comprised of an elongated rod, preferably of a metallic material and bent in such a fashion as to form: a support having a cross-piece portion 12*a*; two downwardly-depending substantially U-shaped support legs 12*b* and 12*c*; a pair of upwardly-extending side arms 12*d* and 12*e*; and a pair of downwardly-depending side arms 12*f* and 12*g*. A U-shaped axle support portion is provided between each pair of support arms 12*d*–12*f* and 12*e*–12*g*; for example, as shown best in FIG. 3*a*, wherein U-shaped axle support portion 12*h* is arranged between arms 12*d* and 12*f*. It should be noted that a U-shaped intermediate portion is provided between arms 12*e* and 12*g* which is substantially identical to the U-shaped portion 12*h* but which has been omitted herein only for purposes of simplicity.

Figure 3B:
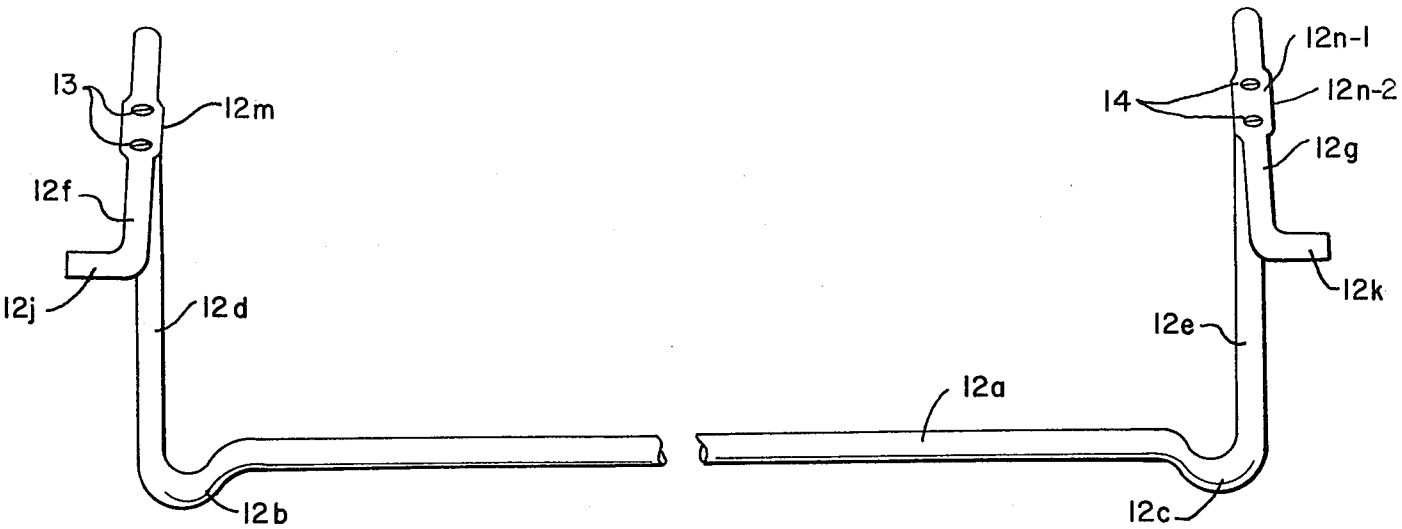

The arms 12*d* and 12*e*, as shown best in FIG. 3*b*, can be seen to be arranged in substantially spaced parallel fashion. However, arms 12*f* and 12*g* can be seen to be bent slightly outwardly from the point where they are joined to the axle supporting portions (see axle supporting portion 12*h*) toward their outwardly-bent free ends 12*j* and 12*k*, respectively.

Figure 1B:
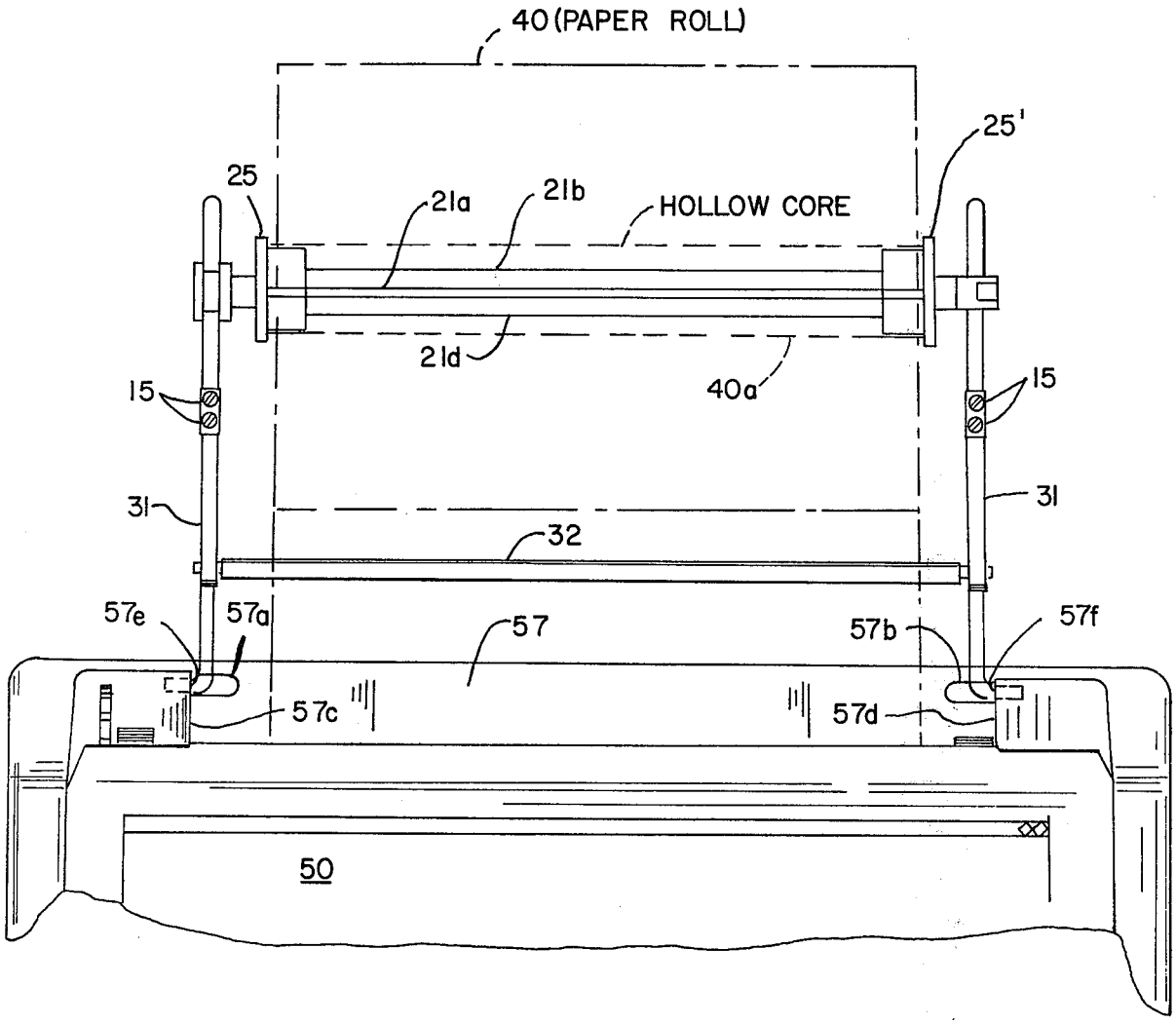
Figure 2B:
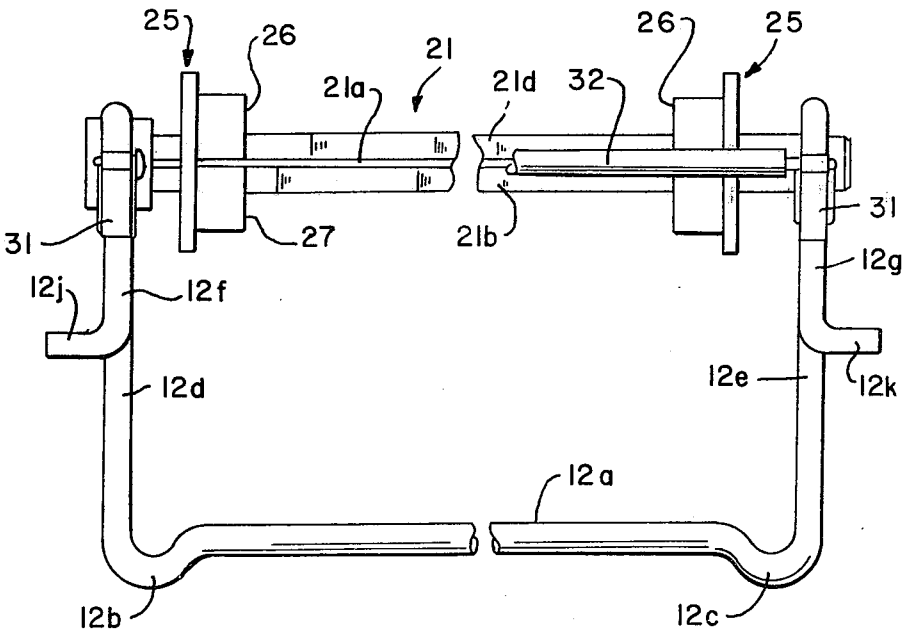
Figure 2A:
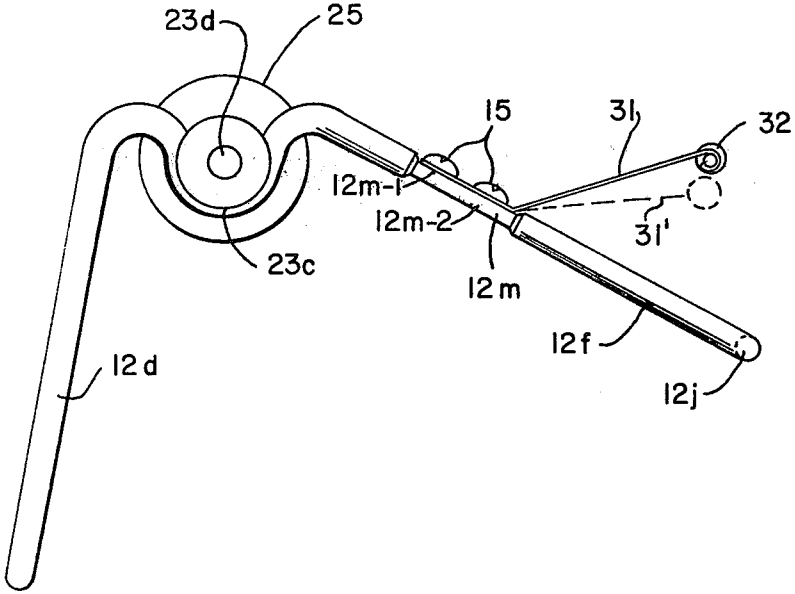

The metallic material from which the holder support 12 is formed has sufficient resiliency to enable the arms 12*f* and 12*g* to be sufficiently yieldable to be urged slightly inwardly toward one another and, when released, to resume their slightly outwardly-bent orientations, as shown in FIG. 3*b*. The outwardly-bent free ends 12*j* and 12*k* of holder support 12 are adapted to be releasably secured to the adjacent sidewall of the printer housing in the following manner:

The arms 12*f* and 12*g* are bent inwardly and are positioned so that their free ends 12*j* and 12*k* are aligned immediately above the semicircular-shaped recesses 57*a* and 57*b*, shown best in FIG. 1*b*. The free ends 12*j* and 12*k* are then pressed downwardly so as to be seated in the semicircular-shaped recesses 57*a* and 57*b*. In this position, the arms 12*f* and 12*g* are then released, whereby the arms move outwardly due to their normal resiliency, so that their free ends 12*j* and 12*k* respectively enter into the openings 57*e* and 57*f* in the sidewalls 57*c* and 57*d* embracing opposite sides of the printer shelf 57. In this manner, the supply roll holder 11 is secured to the printer 50 and is positively located relative to the printer housing 51 and further serves as the means for supporting and properly orienting the paper supply roll holder relative to the printer to assure smooth, proper operation thereof.

Figure 4B:
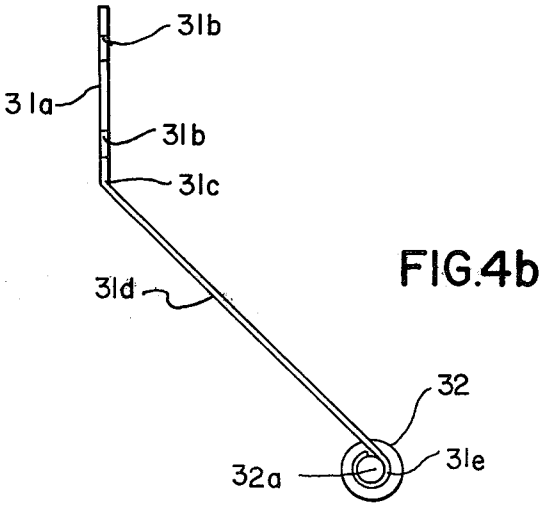
Figure 4A:
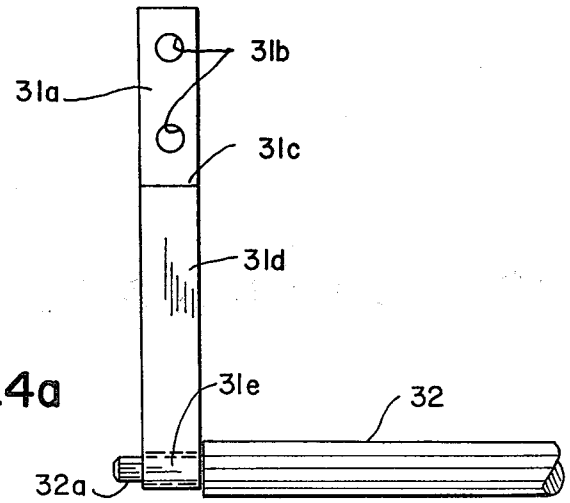
Figure 3A:
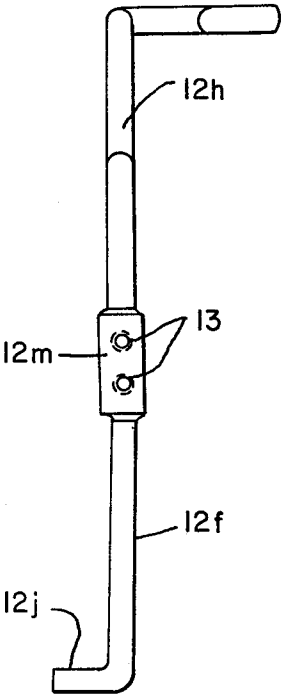

Considering FIGS. 3*a* and 3*b*, the arms 12*f* and 12*g* can be seen to be provided with reduced thickness portions 12*m* and 12*n*, whose top and bottom surfaces 12*m*-1, 12*m*-2, and 12*n*-1, 12*n*-2 are substantially flat. Each of said reduced thickness portions is provided with a pair of openings 13 and 14 adapted to receive fastening members 15 shown, for example, in FIG. 2. The openings 13 and 14 are preferably tapped to threadedly engage the threaded fastening members 15. The reduced thickness portions 12*m* and 12*n* are each adapted to position and support the mounting end 31*a* of a dancer bar supporting spring 31 shown best, for example, in FIGS. 4*a* and 4*b*. The mounting end 31*a* is provided with a pair of openings 31*b* for alignment with the tapped openings 13 and 14 in each arm 12*f* and 12*g*. The spring is bent at 31*c*, whereby a straight linear resilient portion 31*d* extends upwardly and away from the mounting portion, as can best be seen in FIG. 4*b*. The free end of each spring is bent as shown at 31*e* to form a substantially circular-shaped free end which is adapted to receive and embrace the small diameter end portion 32*a* of dancer rod 32. FIG. 4 shows one end portion of dancer rod 32, it being understood that the opposite end is substantially identical and receives a spring identical to the spring 31.

Figure 5B:
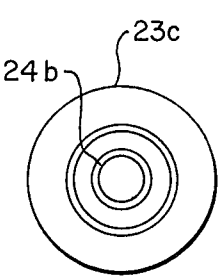
Figure 5A:
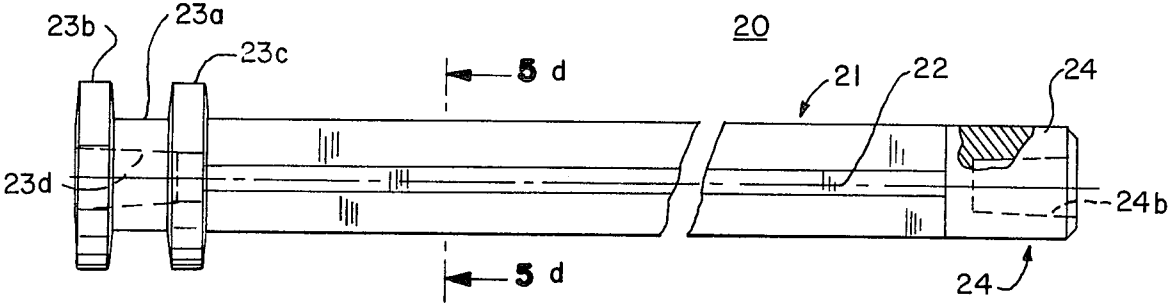
Figure 5C:
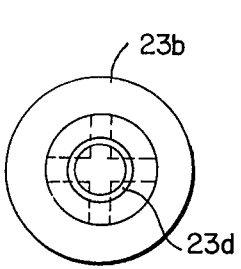
Figure 5F:
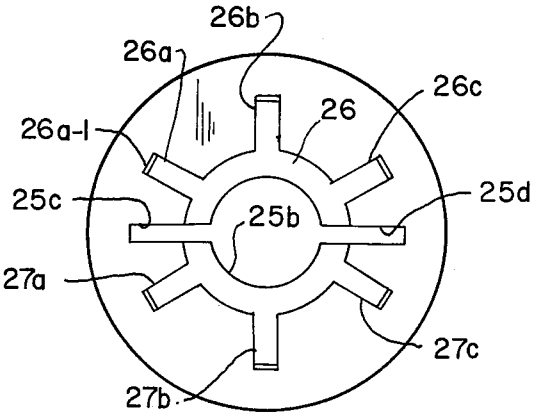
Figure 5E:
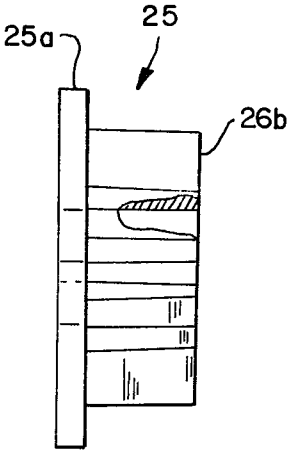
Figure 5D:
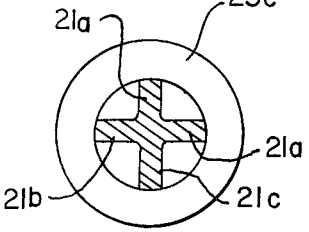

As shown best in FIGS. 1*a*, 1*b*, 2*a*, 2*b*, and 5*a* through 5*c*, each axle supporting portion, such as, for example, the axle supporting portion 12*h* of the holder support 12, is adapted to receive and freely rotatably support axle assembly 20 shown in detail in FIGS. 5*a* through 5*c*. The paper supply roll axle assembly 20 is comprised of an elongated portion 21 having a substantially X-shaped cross-sectional configuration, as shown best in FIG. 5*d* and which is comprised of four arms 21*a*–21*d* extending radially outward from the longitudinal axis of rotation 22. The cross-sectional configuration of FIG. 5*d* is a sectional view looking in the direction of lines 5*d*–5*d* of FIG. 5*a*.

A roller assembly 23 is integral with the left-hand end of elongated X-shaped axle member 21 and is comprised of a central cylindrical-shaped recessed portion 23*a* having a pair of circular-shaped disk-like flanges 23*b* and 23*c* arranged on opposite sides of intermediate cylindrical-shaped recessed portion 23*a*. The outer end thereof is provided with a tapered bore 23*d* for receiving a holding pin, to be more fully described.

The opposite end of elongated X-shaped axle member 21 has an integral end cap 24. End cap 24 has a substantially cylindrical-shaped periphery 24*a* and is similarly provided with a tapered bore 24*b* for receiving a holding pin, as will be more fully described.

The axial assembly 20 is further comprised of a pair of adjustable end caps 25 and 26, slideably mounted along elongated X-shaped axle member 21. Since both of these members are substantially identical in both design and function, only one of said members will be described herein for purposes of simplicity. Turning to a consideration of FIGS. 5*e* and 5*f*, it can be seen that left-hand end cap 25 (relative to FIG. 2*b*) has a disk-shaped portion 25*a* provided with a centrally-located circular-shaped opening 25*b*. A pair of slots extend radially outward from said centrally-shaped opening 25*b* and lie along a common diameter, said slots being shown at 25*c* and 25*d*, respectively.

A pair of substantially semicircular-shaped projections 26 and 27 immediately surround circular-shaped opening 25*b*. Each of these projections 26 and 27 is provided with a plurality of radially outwardly-extending projections 26*a*–26*c* and 27*a*–27*c*, respectively. The outer edges of these projections, for example, the outer edge of projection 26*a*-1 of projection 26*a*, is slightly tapered to facilitate insertion of the six projections 26*a*–26*c* and 27*a*–27*c* into the hollow core of a paper supply roll 40.

The end caps 25 and 25′ are slideably mounted along X-shaped axle portion 21. The slots 25*c* and 25*d* provide the end cap disco-shaped portion 25*a* with some resiliency to allow the end cap portion to be slightly yieldable in order to allow the end caps to be slideably moved, either toward or away from one another in order to accommodate paper supply rolls of differing axial lengths and also in order to be able to center the particular paper supply roll mounted upon the axle assembly.

The manner of use of the axle assembly is as follows:

Presuming that the axle assembly 20 has been removed from the holder support 12, end cap 25′ is completely removed from the axle assembly. Thereafter, the cap 24 is inserted into the hollow core 40*a* of the paper supply roll 40. The outer edges of the radially-aligned arms 21*a* through 21*d* do not engage the interior surface of the paper supply roll hollow cylindrical-shaped core 40*a* due to their substantially small diameter relative to the paper roll core 40*a*. The end cap 25 is pressed into the paper supply roll core 40*a*, which is centered upon the axle assembly. The fit between the hollow cylindrical core 40*a* of the paper supply roll 40 and the end cap 25 is a close press fit.

End cap 25′ is remounted upon the axle assembly, and the projections of the end caps 25 and 25′ are firmly force-fitted into the adjacent ends of the hollow cylindrical core 40*a* of the paper supply roll 40. Centering may be accomplished at this time or, alternatively, may be accomplished after the axle assembly is mounted upon the supply roll holder support.

After mounting of the paper supply roll 40 upon the axle assembly 20 and a light force-fitting insertion of the end caps 25 and 25′ into the ends of the paper supply roll 40, the axle assembly 20 is placed upon the holder support 12 by positioning cylindrical-shaped recessed portion 23*a* of roller-like assembly 23 immediately above the left-hand U-shaped axle support portion 12*h* of support 12. The outer disk-shaped portions 23*b* and 23*c* prevent the axle assembly 20 from any movement along its longitudinal axis relative to support 12 while, at the same time, permitting the axle assembly to rotate freely about its longitudinal axis relative to support 12. The cylindrical-shaped cap 24, provided at the opposite end of axle assembly 20, simply rests upon the U-shaped axle support portion of support 12 which is arranged between arms 12*e* and 12*g*, as was previously described. It should be obvious that removal of the paper reel occurs in substantially the reverse order, wherein once the paper supply reel is exhausted, cylindrical-shaped cap 24 and roller assembly portion 23 are lifted upwardly and away from the support 12; end cap 25′ is removed from the axle assembly; and the remaining hollow cylindrical-shaped core 40*a* of the exhausted paper supply roll 40 is removed, after which the steps employed for mounting a fresh paper supply roll 40 upon the axial assembly are the same as those described hereinabove.

With a fresh paper supply roll being mounted upon the axle assembly 20 and with the axle assembly 20 being mounted upon the U-shaped portions (see 12*h*) of the holder support 12, the paper may now be fed into the printer. Noting especially FIG. 1*a*, the paper is fed from beneath the supply roll 40, wherein paper portion $P_1$ can be seen to be directed diagonally upward, so as to extend over the top of dancer rod 32. Thereafter, the paper extends over and upon the dancer roll 32 and then diagonally downwardly toward the printer housing 51 and into an opening in the adjacent side of the printer 50, where it passes between paper fed roller 52 and pinch rollers 53 and then upwardly along the right-hand side of feed roller 52, wherein the paper extends through the narrow gap defined by the printing surface of platen 54 and the forward nose 55*a* of print head 55.

The paper supply roll holder of the present invention may be used to great advantage with the printer of the type briefly described herein and described in greater detail in copending applications Ser. No. 40,911, filed May 21, 1979 and assigned to the assignee of the present invention. The printer described therein is provided with an incremental feed means (not shown in the present application for purposes of simplicity), which is arranged to drive the paper feed roller 52 in an incremental fashion. More specifically, the paper feed mechanism abruptly rotates the paper feed roller 52 through an angle usually of the order of 10° to 20°, depending upon the particular line feed distance desired. The incremental line feed mechanism is adapted to abruptly feed the paper sheet. The fact that the paper sheet is pinched between pinch rollers 53 and paper feed roller 52 causes rotation of the feed roller 52 to be imparted to the paper web which serves to abruptly pull the paper web into the printer 50 and more specifically serves to pull the portion of the paper web $P_2$ in the downward diagonal direction shown by arrow 57. The abrupt movement of the paper web causes the resilient dancer spring elements 31 to be urged downwardly so as to move from the solid-line position 31, shown in FIG. 2*a*, to the dotted-line position 31′, also shown in FIG. 2*a*. Thus, abrupt movement of the paper web serves to urge the dancer bar 32 substantially in a downward direction, causing the dancer bar springs 31 to be flexed, as shown by the dotted-line configuration 31′. It can clearly be seen that the web portion $P_1$ and the supply roll 40, yet to be unraveled, experiences effectively no movement whatsoever, the dancer rod 32 and the dancer rod support springs 31 serving to substantially fully absorb the abrupt movement imparted to the portion of the paper web extending to the right of dancer rod 32 (relative to FIGS. 1*a* and 2*a*).

Thereafter, the paper web feed operation typically pauses at least long enough for the printing of a full line. Since the web is substantially incapable of being stretched, the portion of the web extending between dancer rod 32 and the printer experiences no movement. However, the dancer rod springs 31 begin to move from their flexed position, shown by dotted-line configuration 31′, back to their rest position, shown by solid-line 31 of FIG 2*a*, which return action is significantly less abrupt, i.e., the return of the springs 31 to their rest position occurs at a rate which is significantly slower than the original abrupt feeding applied to the paper web so as to gradually and substantially gently pull the large mass, high inertia paper supply roll 40 through an angle of rotation in the counterclockwise direction, as shown by arrow 33.

Even in the case where the paper feed mechanism is operated to perform a plurality of successively repeated feed operations, for example, to feed the paper web rapidly through ten "line feed" movements, the time required for the paper feed mechanism to return to its rest position before it performs its successive abrupt paper incremental paper feed operation is of sufficient length to allow the dancer rod 32 to enable the supply roll 40 to feed at a less abrupt and hence non-jerky manner. In addition, there is sufficient frictional drag between the dancer roll and the paper supply reel, which is substantially maintained in a somewhat-taught fashion, to prevent the paper from completely slipping about the dancer bar 32, so as to impart an abrupt pull upon the portion of the paper web to the left of the dancer rod 32 and the paper supply roll per se, thereby preventing the paper supply roll from unraveling unnecessarily, thereby assuring a neat, orderly unwinding of the paper web from the paper supply roll.

The tapered bores **23*d* and 24*b*, provided in end cap members 23 and 24 of the axle assembly 20, may be utilized to receive holding pins for facilitating the lifting and replacement of the axle assembly upon the holder support 12. For example, the members 23, 24 may be adapted to receive the tapered heads of a pair of blunt instruments to facilitate lifting of the axle assembly and paper supply roll. In addition, the axle assembly may be adapted for use with a holder support of alternative design, i.e., one in which the U-shaped support portions, such as support portion 12*h* of support 12 is eliminated and replaced with an inwardly-directed projection for insertion into tapered opening 23*d*. A similar projection may be provided at the opposite axle supporting end of the holder support for insertion into the tapered bore 24*b*, shown in FIG. 5*d***.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A holder assembly for a paper supply roll comprised of an elongated paper web of indeterminate length being wound in the form of a paper supply roll, said holder assembly comprising:

an axle assembly insertable through the central opening of said paper supply roll;

holder support means for rotatably supporting the free ends of said axle assembly;

dancer bar means including a dancer bar and means for resiliently mounting said dancer bar to said holder support means;

the paper from said paper supply roll extending from said supply roll and being guided about said dancer bar so as to move the dancer bar against its resilient mounting means during a paper feed operation; and said resilient dancer bar support means being adapted to yieldably bend upon the abrupt feeding of the portion of the paper web extending away from said dancer bar, whereby said resilient mounting means act to substantially fully absorb any abrupt pulling of the paper web during feeding of the paper in order to prevent the abrupt pulling of the paper web to be imparted to the paper supply roll to assure that the paper will be fed in a neat, orderly fashion.

2. The holder assembly of claim 1, wherein said holder support means further include connecting means for releasably engaging mounting openings provided upon the printer.

3. The apparatus of claim 2, wherein said holder support means is comprised of a one-piece member in the form of an elongated rod bent to define holder feet means and axle support means; said connecting means comprising arms extending from the portions of the one-piece member forming said axle support means.

4. The paper supply roll holder assembly of claim 2, wherein said holder comprises a one-piece rod bent to form a spanning connector portion, two downwardly-depending feet integrally joined to said connector portion, a pair of rearward-upwardly directed support portions integrally joined to said feet;

said connecting means comprising a pair of downwardly-directed releasable connector portions formed as an integral part of said rod; and a pair of substantially U-shaped axle assembly support portions, each being integrally joined between one of said upwardly-directed rearward support portions and downwardly-directed releasable connector portions.

5. The apparatus of claim 4, wherein the connector portions are each provided with a spring-mounted surface intermediate with the ends of said connector portions;

said support means comprising spring means having a mounting portion secured to the mounting portion of an associated one of said arms; said spring means extending at an angle from said mounting portion and being provided with an opening formed at the free end of each spring means; and said dancer rod being an elongated rigid rod having smaller diameter projections at the ends thereof insertable into the openings of said spring means.

6. The apparatus of claim 1, wherein said axle means is comprised of an elongated axle portion having at least one end cap at one end of said axle portion;

said end cap having a central, cylindrical-shaped recess of reduced diameter being positioned upon one of said U-shaped axle-receiving portions, wherein opposite sidewalls of said recess prevent said axle assembly from experiencing movement along its longitudinal axis relative to said holder support; and the opposite end of said axle portion being slideably received upon the remaining U-shaped axle support.

7. The apparatus of claim 6, further comprising a pair of supply roll supporting end caps slideably mounted along said elongated axle member and having a plurality of projections arranged along one side of each end cap and having a plurality of diagonally-aligned engaging surfaces for engaging the interior surface of the hollow, cylindrical-shaped core of a paper supply roll; and said supply roll supporting end caps being provided with openings adapted to frictionally engage said elongated axle member and yet being slideable therealong in order to adjust the position of a paper supply roll along the axial length of said elongated axle member.

8. The apparatus of claim 5, wherein said elongated axle member is provided with a substantially X-shaped cross-sectional configuration defined by a plurality of outwardly-directed radially-aligned arms defining said X-shaped configuration.

9. The apparatus of claim 8, wherein the end of said axle portion opposite said one end is provided with a cylindrical-shaped end cap adapted to be supported upon one of the axle-supporting portions of said holder.

10. The apparatus of claim 9, wherein the free ends of both of said end caps are provided with inwardly-directed tapered bores.

11. The apparatus of claim 8, wherein said arms are arranged at 90° intervals.

12. The apparatus of claim 5, wherein the connecting arms are bent so as to be directed slightly diagonally away from one another; the free ends of said arms being bent outwardly, forming short joining ends adapted to be received in the openings provided in said printer, whereby said arms are adapted to be yieldable to be bent slightly inwardly in order to be inserted into said openings on said printer to positively locate the paper supply roll holder relative to the paper feed means of said printer.

* * * * *